US005133395A

United States Patent [19]

Moore

[11] Patent Number: 5,133,395

[45] Date of Patent: Jul. 28, 1992

[54] GOLF CLUB PROTECTOR

[76] Inventor: William C. Moore, 615 N. Main St., Mullins, S.C. 29574

[21] Appl. No.: 696,801

[22] Filed: May 7, 1991

[51] Int. Cl.[5] ..... A63B 57/00

[52] U.S. Cl. ..... 150/160; 206/315.2

[58] Field of Search ..... 150/154, 159, 160; D21/221; 206/315.1-315.6; 273/32 R-32 E

[56] References Cited

U.S. PATENT DOCUMENTS

| | | | |
|---|---|---|---|
| 1,336,092 | 4/1920 | Schenkelberger | 206/315.1 X |
| 1,886,464 | 11/1932 | Bright | 150/160 |
| 2,595,987 | 5/1952 | Shears | 206/315.6 |
| 3,053,298 | 9/1962 | Stamp | 206/315.2 |
| 3,603,368 | 9/1971 | Brenner | 150/160 |
| 3,967,667 | 7/1976 | Robinson | 206/315.6 |
| 4,173,241 | 11/1979 | Stock | 206/315.6 |
| 4,497,404 | 2/1985 | Lowrance | 150/160 X |
| 4,838,416 | 6/1989 | Carman | 150/160 X |
| 4,932,523 | 6/1990 | Yamazoe | 206/315.2 X |
| 4,979,548 | 12/1990 | Howard, III et al. | 150/159 |

*Primary Examiner*—Sue A. Weaver

*Attorney, Agent, or Firm*—Sughrue, Mion, Zinn, Macpeak & Seas

[57] ABSTRACT

A golf club protector is in the form of a hollow, tubular sleeve constructed from a single, elongated piece of material folded lengthwise and secured together along the elongated edges and one end of the tube. The edges of the tube are straight and diverge from the closed end of the tube to the open end of the tube. The tube is substantially longer than the length of the club for which it is designed to protect.

1 Claim, 1 Drawing Sheet

FIG.1
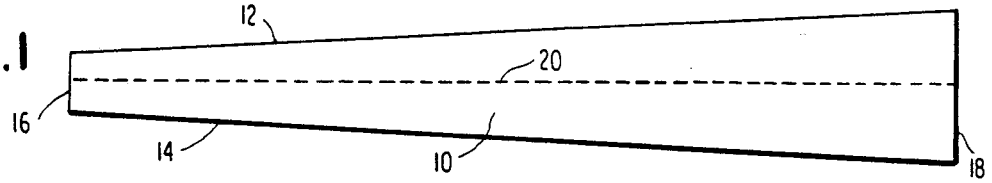
FIG.2
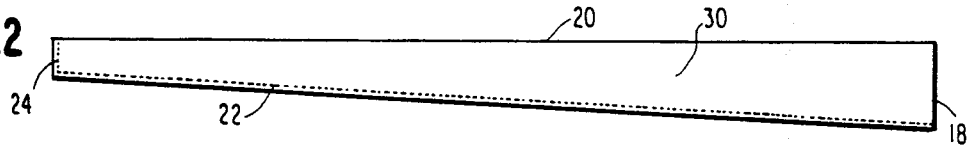
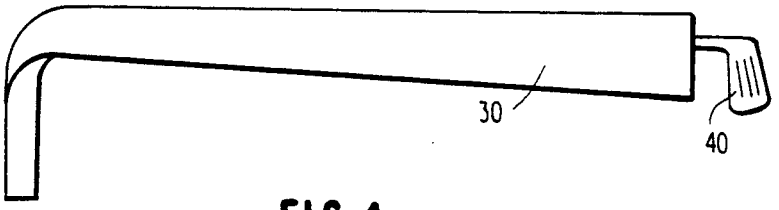
FIG.3
FIG.4
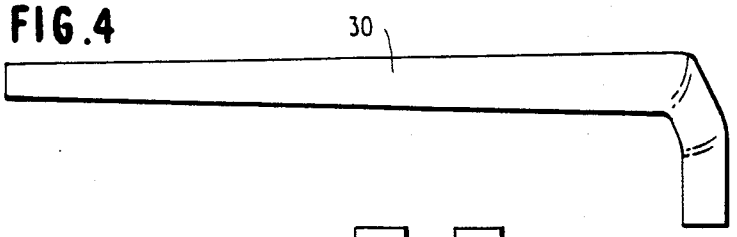
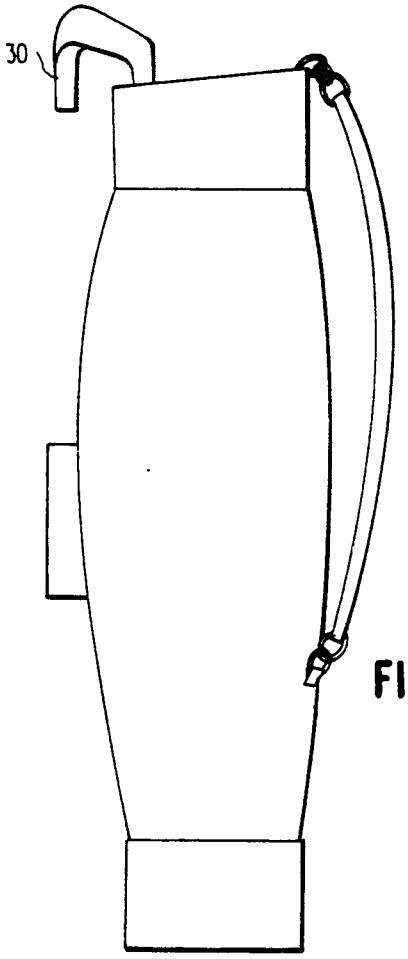
FIG.5
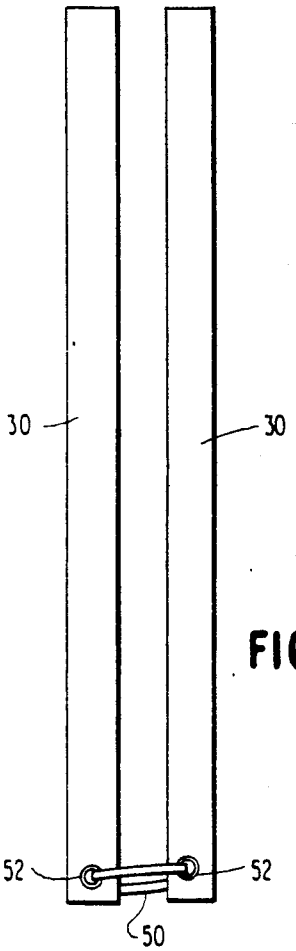
FIG.6

GOLF CLUB PROTECTOR

BACKGROUND OF THE INVENTION

The present invention is directed to a golf club protector and more specifically to an elongated tubular sleeve which is closed at one end for receiving a golf club and which has a length considerably longer than the length of the golf club so that the open end of the sleeve hangs downwardly beyond the end of the club head.

Golfers often remove more than one club at a time from the golf bag and lay the extra clubs on the ground while making a shot with another club. As a result, the clubs, especially the grips, can be contaminated by moisture and/or dirt and therefore require cleaning before they can be used.

Golf clubs are also subject to damage when stored separately in a locker or a car. The grips and shafts, especially the new fiberglass shafts, can be damaged during insertion and removal of the clubs from a golf bag or tubes therein.

The use of elongated tubular cloth sleeves for protecting golf clubs are generally old and well known in the art as evidenced by the patents to Brenner (U.S. Pat. No. 3,603,368) and Bright (U.S. Pat. No. 1,886,464).

The sleeve of Brenner is open at opposite ends with the upper end being flared outwardly to accommodate the club head. The upper portion of the sleeve is provided with an extension which is located on one side of the cover. Complementary fastening means are provided on the extension and the opposite side of the sleeve so that the extension may be folded over the club head and secured to the opposite side of the sleeve. The fastener on the extension of one sleeve can be secured to the fastener on the side of another sleeve to secure the sleeves together. Alternatively, one or more cords may be threaded through suitable apertures in each of a plurality of sleeves to secure the sleeves together.

The golf club cover disclosed by Bright is also in the form of a sleeve having a flared out portion at the upper end thereof, the upper half of which is sewed or otherwise fastened closed to form a pocket into which the upper end of the club may fit when desired. Immediately below the pocket, the casing is open to permit the club to be seen and to permit the head of the club to project therethrough when it is desired to display it or remove it. Fastening means are provided for normally closing the opening.

In both of the prior art constructions, considerable material and labor is required in order to form the shaped end portion for receiving the club head. Fasteners also add to the cost and complexity of the construction of the golf club protector.

SUMMARY OF THE INVENTION

The present invention provides a new and improved golf club protector which is extremely simple to manufacture and easy to use while providing complete protection for the entire length of the golf club.

The present invention provides a new and improved golf club protector comprised of a single elongated piece of material folded lengthwise with the free edges stitched along one side and one end to define an open ended tubular sleeve having a length substantially greater than the length of the golf club to be inserted therein. The longitudinal straight edges of the piece of material may diverge away from each other from the closed end of the sleeve to the open end of the sleeve to provide sufficient width adjacent the open end of the sleeve to accommodate a golf club head. A cord may be threaded through openings in each sleeve adjacent the closed end thereof for securing the sleeves together within a golf bag.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 1 is a plan view of the piece of material from which the sleeve is made.

FIG. 2 is a side view of the finished sleeve.

FIG. 3 is a side view showing a golf club partially inserted into a sleeve.

FIG. 4 is a side view showing a golf club completely inserted within the sleeve.

FIG. 5 is a side elevation view of a golf bag having a single club in a protective sleeve disposed therein.

FIG. 6 is a side view of a plurality of sleeves connected together at the closed ends thereof.

DETAILED DESCRIPTION OF THE INVENTION

The protective sleeve according to the present invention is made from a single piece of material 10 as shown in FIG. 1. The piece of material is provided with straight diverging side edges 12 and 14 and parallel end edges 16 and 18. The piece of material has a length substantially greater than the length of the club for which it is intended and the piece of material 10 is folded lengthwise about a fold line 20 into the configuration shown in FIG. 2. The adjacent side edges 12 and 14 are secured together by means of a seam 22 and the bottom edges are secured by means of a seam 24. Thus, an open ended tube is provided with the open end adjacent the edges 18 being substantially wider than the closed end adjacent the edges 16.

The tube may be constructed of any suitable material. Preferably the material is flexible and lightweight such as nylon or the like which is durable and water repellant. It is possible to construct the sleeve from waterproof material or to coat the nylon with a waterproofing substance which is well known in the art. It is also possible to line the tube with a softer material to provide further protection for the golf club but such a lining is not necessary for providing the basic protection for the club against abrasion and moisture.

A golf club 40 may readily be inserted handle first into the sleeve 30 as shown in FIGS. 3 and 4. When the golf club is fully inserted into the sleeve as shown in FIG. 4, the sleeve will extend substantially beyond the end of the club and depend freely therefrom to fully protect the club by preventing the entry of foreign material and/or moisture into the sleeve.

When the club and the protective sleeve thereon are inserted into a golf bag as shown in FIG. 5, the free end of the material will hang downwardly from the club head over the edge of the golf bag. Each sleeve may be provided with suitable indicia to indicate the number of the club within the sleeve. It is also possible to have a different color sleeve for each number club, thereby providing an attractive display of color a the top of the golf bag.

When it is desired to remove the club from the bag, the golfer may remove the club along with the protective sleeve. The sleeve can then be removed and either dropped on the ground or placed into the golfer's pocket or a pocket on the golf bag by the golfer using the club. Frequently, golfers will take two or three clubs from the bag at one time and carry them to the ball location. The clubs which are not being used for that particular shot can merely be left within the sleeve and placed on the ground without fear of contaminating the handles of the clubs with dirt or moisture. Alternatively, the golfer can leave the sleeve in the bag and merely extract the club from the sleeve. In this case, the upper end of the sleeve can merely be draped over the edge of the bag for ready access when it is desired to return the club to the sleeve. If the golfer prefers this mode of operation, it is also possible to connect the lower ends of a plurality of sleeves 30 by means of a cord 50 or the like extending through holes 52 located adjacent the bottom of each sleeve.

While the invention has been particularly shown and described with reference to preferred embodiments thereof, it will be understood by those in the art that the foregoing and other changes in form and details may be made therein without departing from the spirit and scope of the invention.

What is claimed is:

1. A golf club protector for a single golf-club comprised of an elongated single piece of flexible material having parallel end edges and diverging straight side edges, means securing the diverging edges together to define a tapered, tubular sleeve and additional means provided for securing the end edges adjacent a narrower end of said sleeve wherein said sleeve has a length substantially greater than a golf club for which the sleeve is intended so that a wider open end of said sleeve hangs freely downwardly over a hat of a vertically disposed golf club when said club is fully inserted into the sleeve.

* * * * *